US007568301B1

(12) United States Patent
Zemlansky et al.

(10) Patent No.: US 7,568,301 B1
(45) Date of Patent: Aug. 4, 2009

(54) ARTICLE DISPLAY DEVICE

(75) Inventors: Tamara Zemlansky, Akron, OH (US); Steven Kidwell, Highland Village, TX (US)

(73) Assignee: Sterling Jewelers Inc., Akron, OH (US)

( * ) Notice: Subject to any disclaimer, the term of this patent is extended or adjusted under 35 U.S.C. 154(b) by 319 days.

(21) Appl. No.: 11/087,188

(22) Filed: Mar. 24, 2005

(51) Int. Cl.
*B43M 3/00* (2006.01)

(52) U.S. Cl. ..... 40/358; 206/6.1; 206/759

(58) Field of Classification Search ..... 40/358; 248/206.5, 309.4, 683
See application file for complete search history.

(56) References Cited

U.S. PATENT DOCUMENTS

| | | | | | |
|---|---|---|---|---|---|
| 1,265,046 | A | | 5/1918 | Bumham | |
| 1,310,729 | A | | 7/1919 | Appelbee | |
| 1,883,012 | A | | 10/1932 | Shields | |
| 2,000,681 | A | | 5/1935 | Weller | 206/44 |
| 2,883,048 | A | * | 4/1959 | Lentz | 206/562 |
| 2,936,067 | A | * | 5/1960 | Kaskey | 206/759 |
| 3,731,415 | A | * | 5/1973 | Shore | 40/358 |
| 3,942,632 | A | | 3/1976 | Witkoff | 206/45 |
| 4,043,450 | A | | 8/1977 | Rielly | 206/45.14 |
| 4,070,782 | A | * | 1/1978 | Vasallo | 40/323 |
| 4,176,743 | A | * | 12/1979 | Fitzpatrick | 206/214 |
| 4,310,091 | A | | 1/1982 | Hara et al. | 206/455 |
| 4,387,806 | A | * | 6/1983 | Poole et al. | 206/232 |
| 4,413,726 | A | | 11/1983 | Davidson | 206/45.13 |
| 4,424,899 | A | | 1/1984 | Rosenberg | 206/305 |
| 4,501,361 | A | | 2/1985 | Rose, Jr. | 206/493 |
| D306,234 | S | * | 2/1990 | Ferstl | D19/75 |
| 4,917,235 | A | | 4/1990 | Feiler | 206/6.1 |
| 4,936,462 | A | | 6/1990 | Yuen | 206/542 |
| 5,016,752 | A | | 5/1991 | Haugen, Jr. | 206/455 |
| 5,056,192 | A | * | 10/1991 | Grass | 16/251 |
| 5,095,325 | A | * | 3/1992 | Carstens | 396/198 |
| 5,191,972 | A | | 3/1993 | Helzer et al. | 206/840 |
| 5,322,159 | A | | 6/1994 | Houlihan | 206/45.2 |
| 5,775,494 | A | | 7/1998 | Taplin | 206/308.2 |
| 5,839,575 | A | | 11/1998 | Blanco | 206/232 |
| 5,855,345 | A | | 1/1999 | DiMaggio | 248/176.1 |
| 5,967,326 | A | | 10/1999 | Tessler et al. | 206/566 |
| 6,349,820 | B1 | | 2/2002 | Kelley et al. | 206/223 |
| 6,758,330 | B1 | | 7/2004 | Chudada | 206/6.1 |
| 6,779,814 | B2 | | 8/2004 | Polick | 281/15.1 |
| 7,131,616 | B2 | * | 11/2006 | Livingstone | 248/304 |

* cited by examiner

*Primary Examiner*—Joanne Silbermann
(74) *Attorney, Agent, or Firm*—Hahn, Loeser & Parks LLP; John J. Cunniff

(57) ABSTRACT

A device (10) for carrying and displaying articles includes a cover portion (11) and a base portion (12) interconnected by a spine (13). The base portion (12) includes a pedestal (20) with pockets (32) formed therein. The pockets (32) each carry an arm (38) which is pivotal from a first position within the pocket (32) to a second position partially outside the pocket (32). A magnet (52) maintains the arm (38) in the second position. The arm (38) is provided with a recess (40) sized to receive a gem holder (29) which can carry a diamond (28). The cover portion (11) can carry a pad (18) of paper, and the base portion (12) can be provided with a slot (27) to receive other articles. An article receiving area (23) can also be provided to carry information relating to the articles being displayed.

20 Claims, 4 Drawing Sheets

ARTICLE DISPLAY DEVICE

TECHNICAL FIELD

This invention relates to a device which assists in the display of articles, such as products on retail display. More particularly, this invention relates to a device, such as a counterpad, for the retail display of jewelry, diamonds or the like.

BACKGROUND ART

It is often desirable to utilize a device to enhance the presentation of articles sold at retail. Such is particularly the case for items of jewelry and the like. Most typically, such devices take the form of a counterpad with the jewelry or other item, normally being stored in a display case, being removed from the case and placed on the counterpad for a closer and an enhanced inspection by the potential purchaser. The most common type of counterpad is a simple two-leaf pad with a felt or soft covering on which the article may be placed.

More recently, a counterpad has been used which can be stored in a folded condition and which is opened like a book to expose surfaces having various cutouts and recesses into which articles to be displayed, such as items of jewelry, may be placed. However, such counterpads are not readily adapted to, or suited for, displaying items, such as loose diamonds, in a fashion which would enable the prospective purchaser to readily observe them.

Thus, the need exists for a device which can hold items such as loose diamonds for the enhanced display for the potential purchaser.

DISCLOSURE OF THE INVENTION

It is thus an object of the present invention to provide a device which will enhance the retail display of items such as jewelry.

It is another object of the present invention to provide a device, as above, which can readily hold and display items such as loose diamonds.

It is a further object of the present invention to provide a device, as above, in which the loose diamonds may be conveniently held by a conventional gem holder, and the gem holder may be received by the device at an enhanced viewing angle for the potential purchaser.

It is yet another object of the present invention to provide a device, as above, in which loose diamond mounts or settings may be held and displayed in proximity to the loose diamonds.

It is a still further object of the present invention to provide a device, as above, which can hold diamond specification sheets for display in proximity to the loose diamonds.

It is an additional object of the present invention to provide a device, as above, which may also carry a white surface which may be written upon, as desired, by the retailer, or which may be used as a background to enhance the beauty of a loose diamond.

It is still another object of the present invention to provide a device, as above, which can be rendered compact for facile storage.

These and other objects of the present invention, as well as the advantages thereof over existing prior art forms, which will become apparent from the description to follow, are accomplished by the improvements hereinafter described and claimed.

In general, an apparatus for displaying articles includes a base portion having at least one pocket formed therein. An arm is pivoted from a first position within the pocket to a second position wherein one end and a portion of the arm are outside of the pocket. A recess is formed in the one end of the arm, the recess being adapted to hold the article for display.

A preferred exemplary device for displaying articles according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
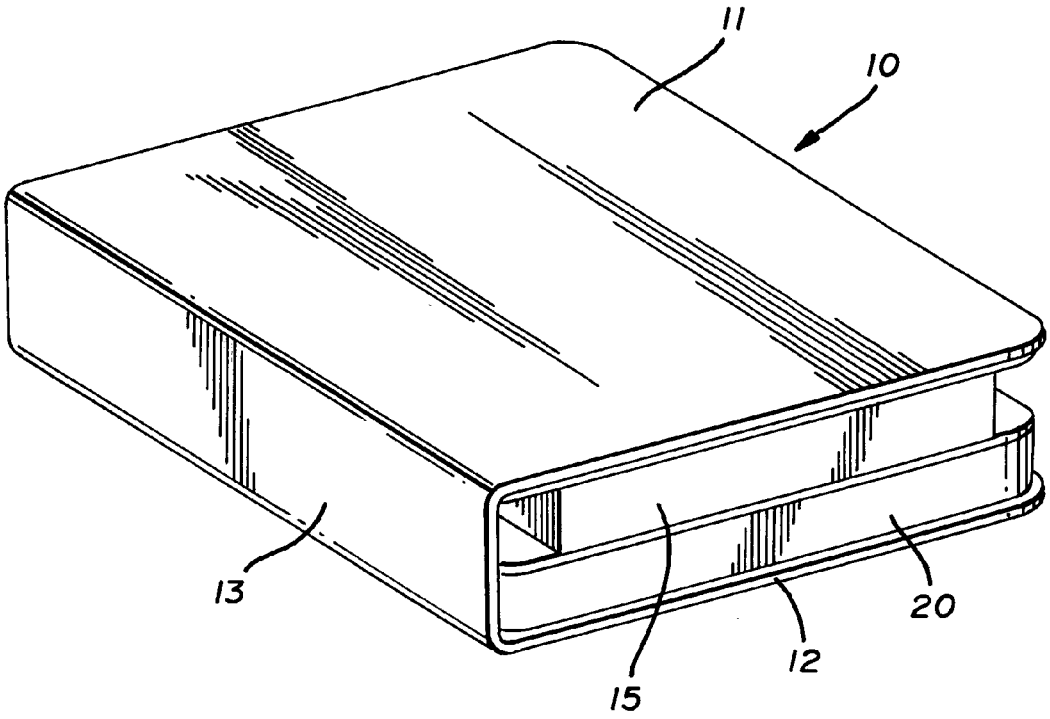
FIG. 1 is a perspective view of an article displaying device made in accordance with the present invention and shown in a closed position for storage.
Figure 4:
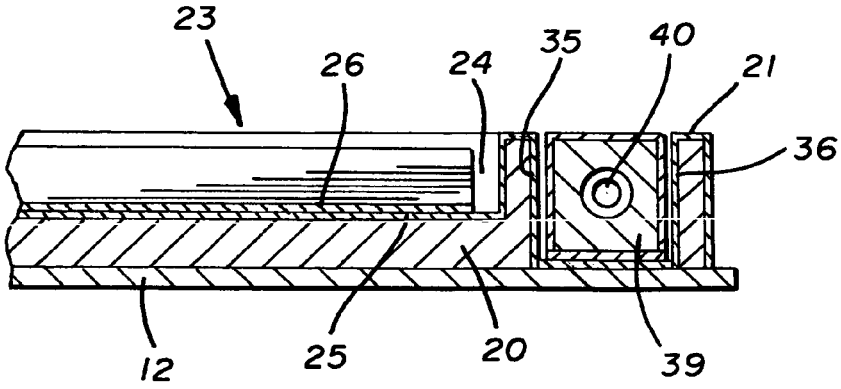
FIG. 4 is a sectional view taken substantially along line 4-4 of FIG. 2.
Figure 2:
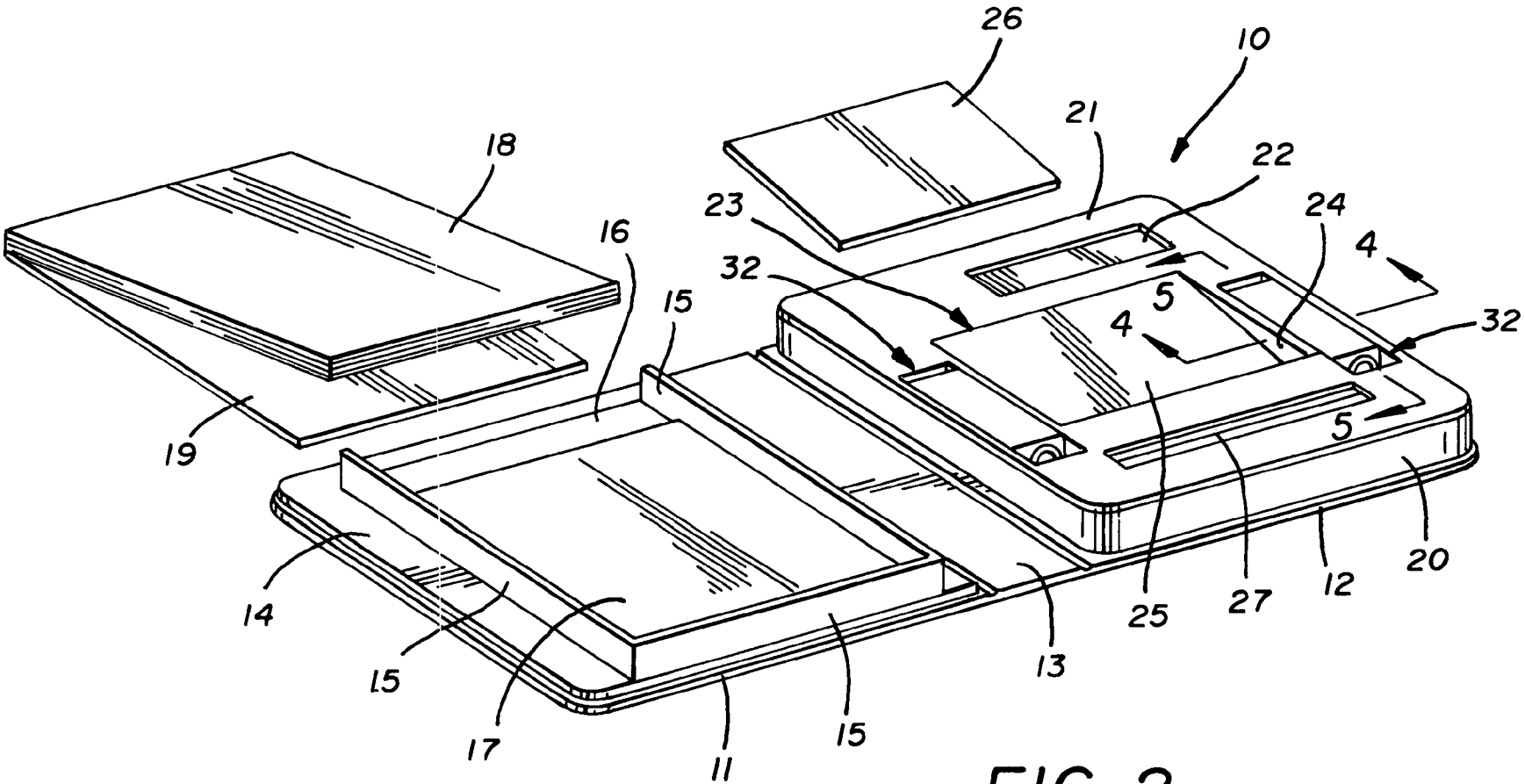
FIG. 2 is a perspective view of the device of FIG. 1 shown in the open position and showing, in exploded form, accessories which can be held by the device to assist in the display of retail items.
Figure 3:
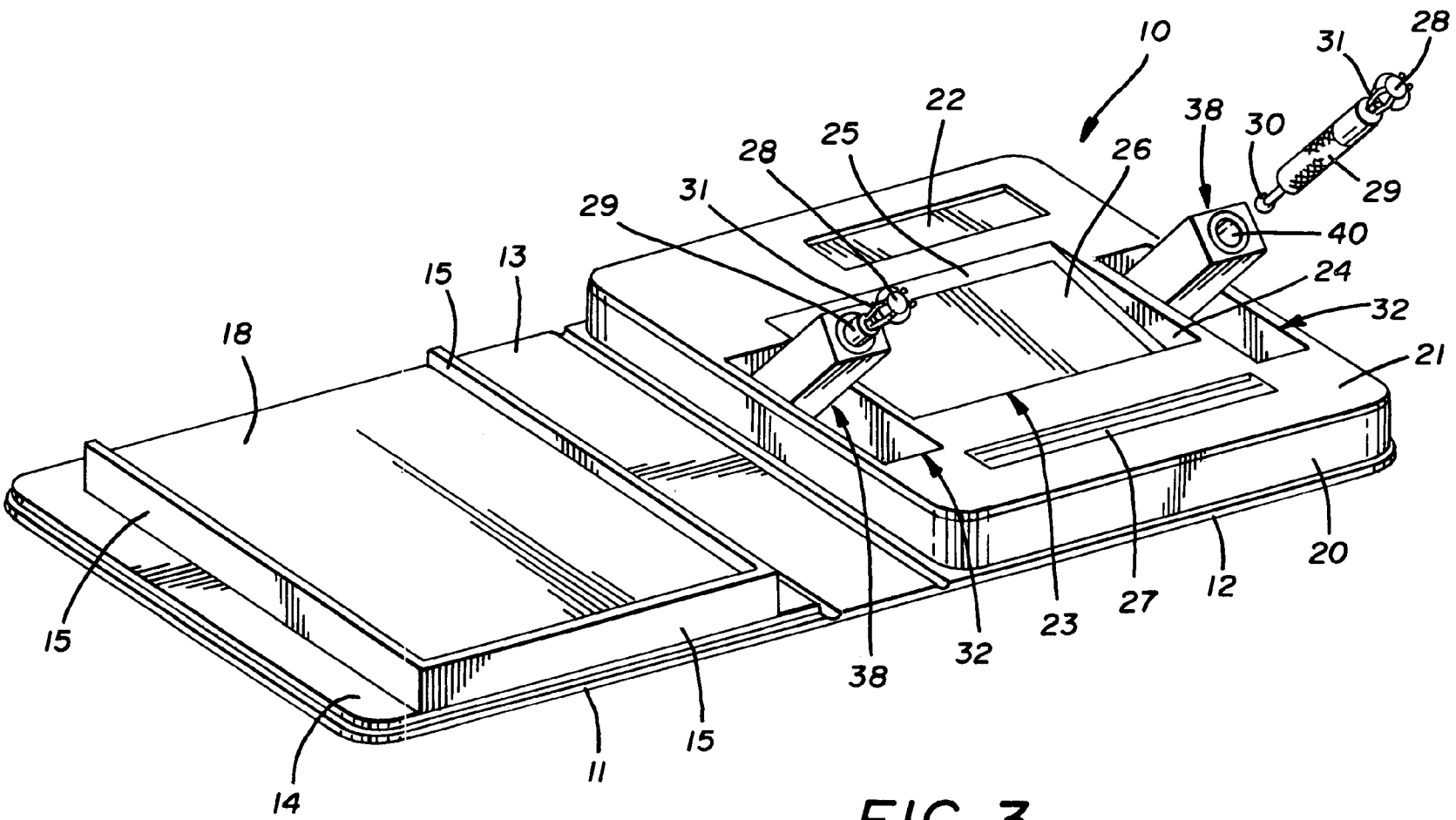
FIG. 3 is a perspective view of the device of FIG. 2 shown in the assembled position and showing the manner in which the device may carry conventional gem holders, one being shown in an exploded form.

A device for carrying and displaying articles, which is particularly suited to enhance the articles for viewing by purchasers at a retail establishment, is generally indicated by the numeral 10. Device 10 includes a cover portion 11 and a base portion 12 which are interconnected by a spine 13. Cover portion 11 and base portion 12 may be constructed of any type of lightweight board-like material which is covered with a soft vinyl-like fabric material which extends into spine 13. As such, device 10 may be stored with portions 11 and 12 in a folded position, as shown in FIG. 1, or cover portion 11 may be pivoted on spine 13 in a hinge-like fashion, to open device 10 for use, as shown in FIGS. 2 and 3.

Cover portion 11 includes an inside vinyl-like fabric surface 14 having a U-shaped frame 15 extending upwardly therefrom. A pocket 16 is formed within frame 15. To that end, a sheet 17 is slightly spaced from surface 14 to form pocket 16. Frame 15 is adapted to receive a pad 18 of paper having a backing or base cardboard sheet 19. As shown in FIG. 2, backing sheet 19 is adapted to be slid into pocket 16 between surface 14 and sheet 17 so that pad 18 may be held within frame 15, as shown in FIG. 3.

A pedestal 20 covered with a vinyl-like fabric 21 extends upwardly from the inside of base portion 12. Pedestal 20 may be formed of a foam or similar lightweight rigid material which is easily formed and coverable by fabric 21, and can be designed to provide several different features. For example, a slight recess 22 which may receive indicia such as a trademark, the name of the retail establishment, or the like. Pedestal 20 may also be provided with an article receiving area generally centrally thereof and generally indicated by the numeral 23. Area 23 is in the form of a recess 24 having a sloped bottom surface 25. Recess 24 can receive an article storage and display container such as shown in U.S. Pat. No. 6,494,316 which can hold rings or the like. More simply, recess 24 can receive a specification sheet 26, as shown in FIGS. 2 and 3, which may provide information regarding items being displayed on device 10. By virtue of sloped bottom surface 25, sheet 26, or whatever is received in recess 24, is sloped toward the potential purchaser of the items for ease of viewing. An elongate slot 27 is also formed in pedestal 20 which can receive one or more items being displayed. For example, one or more rings or mountings for stones could be received in slot 27 for display.

Device 10 is particularly suited to display loose diamonds 28. As depicted in FIG. 3, loose or unmounted diamonds 28 are shown as being carried by a conventional gem holder 29. Typical gem holders 29 have a plunger 30 at one end and a claw 31 at the other end. Depression of plunger 30 expands the claw 31, and after a gem, such as a diamond 28, is received within the claw 31, pressure on the plunger 30 may be relaxed so that the claw 31 engages the diamond 28, as shown in FIG. 3. Typically, the sales associate at a retail establishment would position a gem in claw 31 and merely hold the plunger 30 so that the customer could view the gem. However, device 10 can hold one or more diamonds 28 for facile viewing by a customer, as now will be described.

To that end, pedestal 20 may be provided with one or more pockets (two shown), generally indicated by the numeral 32. Each pocket 32 includes opposed end walls 33, 34, and opposed side walls 35, 36. Walls 33-36 extend upwardly from a bottom pocket surface 37.

Each pocket 32 is adapted to receive an arm generally indicated by the numeral 38. Each arm 38 includes a body portion 39 preferably made of a rigid, lightweight material, such as foam or the like. Each body portion 39 is provided with a longitudinally extending recess 40 which opens out of one end of body portion 39. Each recess 40 can be sized to receive a gem holder 29, as best shown in FIG. 6.

Figure 5:
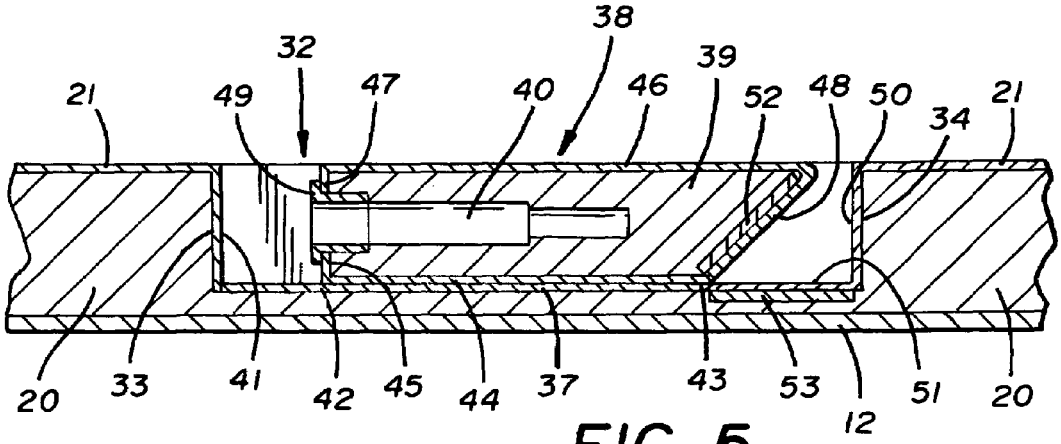
FIG. 5 is a sectional view taken substantially along line 5-5 of FIG. 2.
Figure 6:
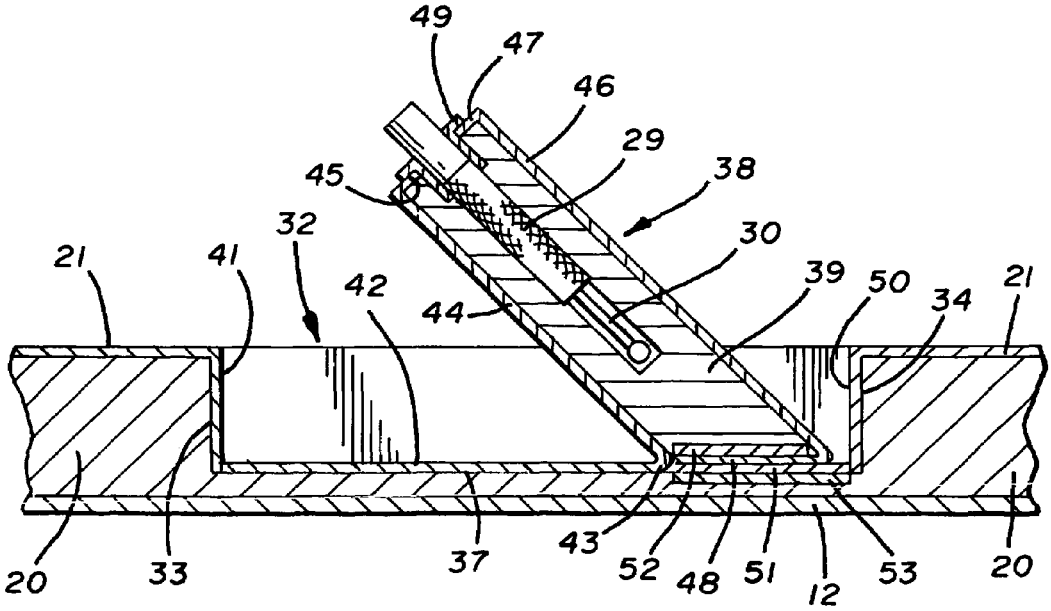
FIG. 6 is a sectional view like FIG. 5, but showing the gem holding arm pivoted upwardly from the stored position of FIG. 5 to the display position.

As best shown in FIGS. 5 and 6, the fabric 21 which covers pedestal 20 extends along each pocket end wall 33, as at 41, and then fabric 41 continues to form a fabric segment 42 which covers a portion of bottom pocket surface 37. The end of fabric segment 42 opposite to fabric 41 forms a hinge 43. On the other side of hinge 43, fabric segment 42 continues, as fabric 44, which covers the bottom side of arm body portion 39. Fabric 44 terminates, as at 45, around the end of arm body portion 39. The top end of arm body portion 39 is provided with a fabric cover 46 which hooks around one end of arm body portion 39, as at 47, and extends along the bottom end of body portion 39, as at 48. A grommet 49 or the like may be inserted in the open end of recess 40 to engage and hold fabric portions 45 and 47. The other end wall 34 of each pocket 32 is covered by a fabric 50 extension of the fabric 21 which covers pedestal 20. The segment of bottom pocket surface 37 not covered by fabric segment 42 is covered by a fabric segment 51 which extends from fabric 50 to abut hinge 43.

A magnet 52 is preferably positioned between fabric 48 and the bottom end of body portion 39 of each arm 38, and a metallic plate 53 may be positioned adjacent to and underneath fabric segment 51. As such, and as will hereinafter be more fully described, when arm 38 is in the position shown in FIG. 6, magnet 52 will be adjacent to plate 53 to maintain arm 38 in that position with the top end and a portion of body 39 of arm 38 being out of pocket 32. Of course, it should be understood that the positions of magnet 52 and plate 53 could be reversed to still accomplish the same result.

Device 10, which may be stored in a compact form, as shown in FIG. 1, is particularly useful for the sales associate of a retail establishment, such as a jewelry store, to promote the sale of diamonds, rings and other jewelry, and is used in the following manner. When opened to the FIG. 2 position, with a pad 18 typically already being in place, if the customer is interested in seeing loose diamonds, one or more of the arms 38 may be pivoted from the FIG. 2 to the FIG. 3 (FIG. 5 to FIG. 6) position where it is held in the upright position by the magnet 52. A gem holder 29, carrying a diamond 28 in a manner previously described, may be placed in the recess 40 of an arm 38 so that the diamond 28 may be easily viewed by the prospective purchaser. The viewing of the diamonds 28 is enhanced by the fact that the arms 38 are maintained at an angle by magnets 52, with a portion of the arm body 39 and the top end of the arm being out of the pocket 32. In addition, a specification sheet 26 conveying information about the particular diamond(s) 28 being displayed can be placed on surface 25, and one or more ring mounts or settings can be positioned in slot 27. Moreover, pad 18 may be utilized to make notes and the like, and if pad 18 consists of bright white paper, a diamond 28 being displayed can be removed from holder 29 and placed on pad 18. Viewing a diamond with a bright white background often enhances the image of the diamond.

It should thus be appreciated that a device 10, as described herein, can be a useful retail marketing tool for diamonds as well as other items of jewelry. As such, a device 10 constructed as described above accomplishes the objects of the invention and otherwise improves the art.

What is claimed is:

1. Apparatus for displaying articles comprising a base portion, at least one pocket formed in said base portion, an arm pivotal from a first position within said pocket to a second position wherein a first end and a portion of said arm are outside said pocket, said first end of said arm having a recess therein adapted to hold an article for display, a magnet positioned on one of said pocket and said arm, and a metallic member positioned on the other of said pocket and said arm, said magnet and metallic member maintaining said arm in said second position such that a second end of said arm contacts the bottom of said pocket.

2. The apparatus of claim 1, additionally comprising a fabric on said arm and said pocket, said fabric connecting said arm to said pocket thereby forming a hinge between said arm and said pocket.

3. The apparatus of claim 2, wherein said hinge consists essentially of said fabric.

4. The apparatus of claim 2, wherein said fabric forms a hinge on a bottom surface of said pocket.

5. The apparatus of claim 2, further comprising a pocket for holding a pad, said pocket for holding a pad being positioned adjacent to said base portion.

6. The apparatus of claim 5, further comprising a cover portion, said cover portion carrying said pocket for holding a pad.

7. The apparatus of claim 6, further comprising a spine between said base portion and said cover portion, said spine rendering said cover portion pivotable from a closed position on said base portion to an open position adjacent to said base portion.

8. The apparatus of claim 6, further comprising a frame on said cover portion, said pocket for holding a pad being positioned within said frame.

9. The apparatus of claim 2, wherein the recess is configured to receive a gem holder.

10. The apparatus of claim 9, further comprising a slot formed in said base member.

11. The apparatus of claim 9, further comprising an article receiving area on said base portion positioned adjacent to said pocket, said article receiving area having a sloped surface.

12. The apparatus of claim 1 further comprising a pocket for holding a pad, said pocket for holding a pad being positioned adjacent to said base portion.

13. The apparatus of claim 12 further comprising a cover portion, said cover portion carrying said pocket for holding a pad.

14. The apparatus of claim 13 further comprising a spine between said base portion and said cover portion, said spine rendering said cover portion pivotable from a closed position on said base portion to an open position adjacent to said base portion.

15. The apparatus of claim 13 further comprising a frame on said cover portion, said pocket for holding a pad being positioned within said frame.

16. The apparatus of claim 1 wherein the article for display is a diamond being held by a gem holder and said recess is configured to receive the gem holder.

17. The apparatus of claim 16 further comprising a slot formed in said base member, said slot being adapted to receive an article associated with the diamond.

18. The apparatus of claim 16 further comprising an article receiving area on said base portion positioned adjacent to said pocket, said article receiving area being adapted to carry information regarding the diamond.

19. The apparatus of claim 18, said article receiving area having a sloped surface.

20. The apparatus of claim 18 further comprising a recess in said base portion adapted to receive indicia.

* * * * *

UNITED STATES PATENT AND TRADEMARK OFFICE

CERTIFICATE OF CORRECTION

PATENT NO. : 7,568,301 B1
APPLICATION NO. : 11/087188
DATED : August 4, 2009
INVENTOR(S) : Zemlansky et al.

It is certified that error appears in the above-identified patent and that said Letters Patent is hereby corrected as shown below:

On the title page,

[*] Notice: Subject to any disclaimer, the term of this patent is extended or adjusted under 35 USC 154(b) by (319) days Delete the phrase "by 319 days" and insert -- by 623 days --

Signed and Sealed this

Sixth Day of April, 2010

David J. Kappos

David J. Kappos
*Director of the United States Patent and Trademark Office*